US009708677B2

(12) United States Patent
Van Eldijk et al.

(10) Patent No.: US 9,708,677 B2
(45) Date of Patent: Jul. 18, 2017

(54) METHOD OF HEAT TREATING A CAST IRON, IN PARTICULAR A NODULAR CAST IRON

(75) Inventors: Pieter Cornelis Van Eldijk, Ijmuiden (NL); Abraham Van Eldijk, Ede (NL)

(73) Assignee: TDI VALUE WEB B.V.; (NL)

( * ) Notice: Subject to any disclaimer, the term of this patent is extended or adjusted under 35 U.S.C. 154(b) by 971 days.

(21) Appl. No.: 14/004,994

(22) PCT Filed: Mar. 13, 2012

(86) PCT No.: PCT/NL2012/050155

§ 371 (c)(1),
(2), (4) Date: Nov. 5, 2013

(87) PCT Pub. No.: WO2012/125031

PCT Pub. Date: Sep. 20, 2012

(65) Prior Publication Data

US 2014/0048185 A1 Feb. 20, 2014

(30) Foreign Application Priority Data

Mar. 14, 2011 (NL) ..... 2006382

(51) Int. Cl.
*C21D 5/00* (2006.01)
*C21D 8/00* (2006.01)

(52) U.S. Cl.
CPC ..... *C21D 5/00* (2013.01); *C21D 8/00* (2013.01); *C21D 8/005* (2013.01)

(58) Field of Classification Search
CPC ..... C21D 5/00
See application file for complete search history.

(56) References Cited

U.S. PATENT DOCUMENTS

| | | | |
|---|---|---|---|
| 2,796,373 | A | 6/1957 | Berg |
| 3,000,770 | A | 9/1961 | Wittmoser |
| 3,013,911 | A | 12/1961 | Peras |
| 3,893,873 | A | 7/1975 | Hanai et al. |
| 4,096,002 | A | 6/1978 | Ikawa |

FOREIGN PATENT DOCUMENTS

| | | |
|---|---|---|
| EP | 0217498 | 4/1987 |

OTHER PUBLICATIONS

International Search Report mailed May 29, 2012, International Patent Application No. PCT/NL2012/050155.

*Primary Examiner* — Rebecca Lee
(74) *Attorney, Agent, or Firm* — Casimir Jones, SC

(57) ABSTRACT

The invention relates to a method of heat treating a cast iron having graphite particles, in particular a cast iron having graphite nodules with a substantially spherical geometry. The method comprises the step of subjecting the cast iron to a first austenitizing temperature, in order to obtain a cast iron having an austenite matrix with a substantially homogeneous carbon content. Subsequently, at least part of the cast iron is subjected to at least a second, different austenitizing temperature in order to change, in at least part of the cast iron, the carbon concentration in a part of the matrix surrounding the (spherical) geometry of the graphite particles. The method yields improved controllability on strength properties characteristics for cast irons including malleable irons, in particular for ductile iron.

10 Claims, 3 Drawing Sheets

METHOD OF HEAT TREATING A CAST IRON, IN PARTICULAR A NODULAR CAST IRON

Figure 1A:
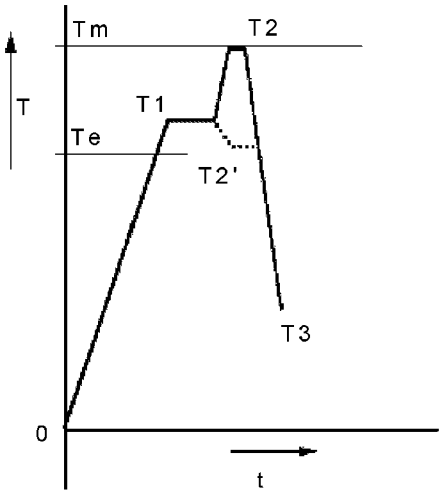

The present invention relates to a method of heat treating a cast iron having graphite particles, and in particular of heat treating a nodular cast iron having graphite nodules with a substantially spherical geometry, according to the pre-amble of claim 1.

Cast iron (~100,000,000 tons/yr worldwide) and steel (~1,000,000,000 tons/yr ww) are the most important materials for construction and transport particularly in applications where strength is critical. With the recent new developments of so called "advanced high strength steels" the further development of the intrinsically high strength properties by hardening of the Fe—C-alloys has only recently started. Cast irons, being also Fe—C-alloys, have an even larger potential for so called "advanced high strength" properties additional to those for steel.

Cast iron can be defined for the major part as a steel matrix containing ~2 to more than 4% C, present as fine distributed graphite particles and/or (partially) dissolved in the steel matrix, and with a silicon content raised up to e.g. 5% Si. The process controlled graphite morphology differs from relatively long sharp edged lamellae (grey or lamellar cast iron), through compacted spheroidal particles (compacted or vermicular cast iron) to irregular shaped spherical particles (as in malleable iron and thick walled ductile iron) and almost perfect spheroidal particles or nodules (as in thin walled nodular cast iron or ductile iron).

Ductile iron, also known as ductile cast iron, nodular cast iron, spheroidal graphite iron, or spherulitic graphite cast iron, is a type of cast iron discovered in the mid of the 20th century. Ductile iron contains carbon in the form of graphite spheroids/nodules, resulting in a specific morphological structure of the graphite. The spheroidal graphite structure is produced by the addition of one or more elements to the molten metal, such elements commonly being referred to as nodularizing agents; on a commercial basis the agent contains magnesium and/or cerium (e.g. NiMg, FeSiMg, coal impregnated with Mg, hollow steel wire filled with Mg and other additives). Due to their shape, these small spheroids/nodules of graphite are better at reducing stress than the finely dispersed graphite flakes in grey iron, for example. For this reason, ductile iron exhibits a greater tensile strength compared to other types of iron. Mechanical properties of ductile iron are comparable to those of steel.

Recently, developments have been made in producing so-called Thin Ductile Iron (TDI). TDI is a spheroidal graphite steel matrix composite having a microstructure with an increased nodule count from 1000 up to more than 7000 nodules per mm2, and a wall thickness (in general) of less than 10 mm. The much finer graphite nodules cause an increase in fatigue strength, and some lowering of fracture toughness. Therefore, smaller wall thicknesses may be used, compared to standard grade ductile iron. Wall thicknesses down to 2 mm, or even 1.5 mm are possible. With these smaller wall thicknesses, TDI provides a superior solution compared to steel forgings, steel weldments and aluminium castings in compact, and/or complex geometries where fatigue strength and weight reduction are critical.

There is a growing need to improve the strength characteristics of cast irons, in order to produce lighter and cheaper components having the same or equal strength characteristics. For instance, (light) rail, truck and car manufacturers are always on the lookout for durable, strong, and lightweight components with suitable fatigue properties that may be used to replace existing materials. With these materials, trucks and cars can become lighter, which allows energy consumption of trucks and cars to become lower. Especially nowadays this is beneficial, with increasingly higher demands on energy consumption.

To control the mechanical properties of cast irons, heat treatments may be used. According to prior art methods, an austempering heat treatment is used. In a typical austempering heat treatment cycle a casting is firstly heated and then held at a chosen austenitizing temperature, e.g. until the entire casting becomes fully austenitic and the matrix becomes saturated with carbon. The saturated carbon-level can be chosen between roughly 0.5% C and 2.0% C depending on the austenitizing temperature, which range is influenced by chemical composition, with Si being the main influencing factor in practical alloys. After the casting is fully austenitized, it is quenched (cooled) at a controlled quenching rate that is high enough to avoid the formation of ferrite or pearlite during the quenching. The casting is then held at a temperature called the austempering temperature. This temperature is above the martensite start temperature for the material. The part is held at the austempering temperature for a time. After the austempering, the casting is cooled to room temperature. Austempered iron possesses excellent comprehensive properties, and more specifically higher strength and toughness compared to regular (heat treated) ductile and malleable irons.

It is an object of the present invention to provide a method with which the mechanical properties of all classes of cast iron, in particular of ductile iron, and in particular strength and toughness, may be improved and/or more accurately controlled. In particular it is an object of the present invention to further increase the strength and toughness of iron castings.

To this end, a heat treating method of the aforementioned kind is provided, that is characterised according to the characterising part of claim 1. A cast iron (such as nodular ductile iron) having graphite particles, is firstly heated and then held at the austenitizing temperature (first temperature) until the entire casting becomes fully austenitic and the matrix becomes saturated with carbon. With austenitizing temperature, it is meant a temperature which is above the Eutectoid temperature of the respective cast iron, and which is below the melting or solidification temperature of the cast iron. The Eutectoid temperature may be in the range of 750° C. to 850° C., and depends on amongst others the Silicon content of the cast iron. The solidification temperature is approximately 1150° C., with a melting temperature being substantially higher than the solidification temperature, which is characteristic for the regarded cast iron alloys. Then, in a subsequent second step, which takes place directly after the first step, the cast iron is heated or cooled within the austenitizing temperature region, to a second temperature that is different from the first temperature. This heating or cooling to the second temperature may in one embodiment be performed very rapidly. The cast iron may be substantially held at this temperature, for example for a relatively short period of time, for example in the order of several minutes. Due to this, the carbon atoms will diffuse from the graphite particles to the matrix, or from the matrix to the graphite particles, depending on whether the second temperature selected is higher or lower than the first temperature, respectively. This yields a relatively small layer in the matrix surrounding the graphite particles with a slightly higher or lower carbon concentration relative to the rest of the matrix, respectively. This slightly higher or lower carbon concentration around the graphite particles results in a slightly different ausferritic microstructure with different residual stresses in the microstructure bordering on the graphite particles and causing a change in strength and toughness characteristics of the cast iron, such as ductile iron. Thus, the subjecting to a second, different austenitizing temperature directly after being subjected to the first austenitizing temperature, may be used to (particularly) increase or also decrease the strength and ductility of the cast iron. Thus, the present invention allows more accurately control of the mechanical properties, and in particular the strength and ductility, of ductile iron. With this, the object of the present invention is achieved.

It is noted that in the current invention, with particles it is meant graphite particles, that are either regular substantially spherical shaped (like in ductile iron), irregular spherical shaped (like in malleable iron), compacted elongated (like in vermicular cast iron) or with a lamellar geometry (like in gray iron). In particular, in an embodiment of the invention, the particles are graphite nodules having a substantially spherical shape, which form of graphite nodules is encountered specifically in austempered ductile iron (ADI).

The invention is largely based on the insight that the graphite particles can be considered as fine distributed carbon reservoirs which enable all kind of heat treatments or hardening operations as in low carbon to high carbon steels. Different from steel is the flexibility in adjusting a certain carbon concentration in the austenite phase during annealing on different austenitizing temperatures, and the possibility of supersaturated carbon concentrations in the austenite phase by superheating the austenite phase beyond the eutectic solidification temperature.

With the method described above, it is possible to obtain a controlled carbon distribution after solidification or more precisely a controlled (positive) carbon gradient, which is for example high in a layer around the graphite particles (e.g. ~3% C) and which is relatively low (e.g. 2% C or 1% C or even 0% C) in a part in the matrix remote from the graphite particles. An opposite (negative) gradient, or no (i.e. zero) gradient is also possible. One of the advantages of a controllable carbon gradient is that it is possible to compensate for decarburization of the matrix that occurs during cooling after austenitizing and before austempering.

In an embodiment, the second austenitizing temperature is higher than the first austenitizing temperature. It is desirable that a higher carbon content in the matrix is achieved, relative to the maximum % C which is soluble in the austenite according to the Fe—C—Si-phase diagram for cooling condition, which is e.g. 2.0% C for Fe—C-0% Si and 1.0% C for Fe—C-5% Si. It is clear that other alloying elements can be taken into account as well, these elements being for instance Mn, Cr, Mo, B, N among others. The higher second austenitizing temperature results in diffusion from the graphite particles to the austenite matrix. Therefore, the graphite content in the layers in the matrix surrounding the graphite particles will be higher, compared to the graphite concentration in the rest of the austenite matrix. When cooling the ductile iron to below the Eutectoid temperature, it is almost always inevitable, due to finite cooling rates and subsequent temperature progress through the austenitizing temperature region, that some diffusion of carbon atoms back into the graphite particles occurs. This decreases the graphite concentration in the layers surrounding the graphite particles, and leads to decreased strength and increased ductility locally in the microstructural matrix. This is often not desired. By heating the cast iron to a second austenitizing temperature that is higher than the first austenitzing temperature, and for instance by holding the cast iron at this second austenitizing temperature for a period of time (in one embodiment some minutes after reaching the desired austenitizing temperature), this detrimental effect to the strength and ductility of the ductile iron is countered. The second higher temperature yields a relatively small substantially spherical layer in the matrix surrounding the graphite particles with a slightly higher carbon concentration relative to the rest of the matrix, in which compressive stresses exist. This causes an increase in the strength and toughness characteristics of the ductile iron after austempering.

The method according to the invention is in particular suitable for heat treatment of thin-walled castings, such as ductile iron and thin-walled malleable iron, where precise fast cooling and heating conditions during heat treatments can be controlled. Due to relatively fast response time of Thin Ductile Iron (TDI) to external changes in temperatures, and smaller diffusion distances between the much finer graphite nodules in TDI in relation to regular DI, it has proven that the method according to the present invention is particularly suitable and advantageous for heat treatment of TDI. Thinner walls mean that the temperature in the core will be decreased or increased more quickly. Thus, when subjecting the TDI to the second, different austenitizing temperature, the temperature in the (core of the) TDI will increase or decrease more quickly, allowing carbon diffusion in the TDI from the graphite nodules to the matrix to take place. Nevertheless, the heat treating method according to the present invention is also suitable for other castings, having a relatively greater wall thickness.

In an embodiment of the invention, the method comprises the step D of, prior to subjecting the cast iron to the first austenitizing temperature (step A), casting a cast iron from a melt for forming cast iron having graphite particles, in particular a nodular cast iron having graphite nodules with a substantially spherical geometry.

In an embodiment, step A is performed directly after step D, i.e. directly after solidification and breaking out of the mould of the casting. With such a procedure long austenitizing procedures resulting in a coarsening of the microstructure can be prevented. This is highly beneficial for the final properties to be realized with step B and steps after step C. Large energy savings are obtained, since in conventional methods, where e.g. ductile iron is cast from molten metal, the cast is cooled towards room temperature, and later on heated again to allow heat treatment of the cast iron to take place. Thus, in conventional methods a lot of energy is in fact being wasted. After such a conventional casting procedure, it takes a relatively long time to achieve a fully austenitized matrix micro-structure in case the matrix already has cooled down sufficiently below the eutectoid temperature and has a substantially ferrite constituent. This effect is even greater when the Si-content increases. To prevent coarsening, and to save a large amount of energy, as well as a large amount of time, it is possible to directly start the heat treatment after the casting process (including the solidification) has taken place. In an embodiment the cast iron is substantially prevented from starting the Eutectoid transformation, in between the casting and solidification and the subjecting to the first austenitizing temperature, to prevent the formation of unwanted ferrite structures in the cast iron. This may be done by exposing the cast iron to a temperature above the Eutectoid temperature. Alternatively, the temperature of the cast iron may drop (slightly) below the Eutectoid temperature for a short period of time, such that no substantial Eutectoid transformation does not yet start. The temperature of the cast iron is in an embodiment held substantially above the Eutectoid temperature.

It should be noted that any heat treating method that starts the (austenitizing) heat treatment directly after the casting of the metal, yields the advantage of large amounts of energy savings. This step is not confined to the use of two different austenitizing temperatures. The applicant reserves the right to apply for protection for this subject matter, in this or other applications.

During the step of casting of the cast iron from the melt, it is possible to use a forming method that allows a quick transition from the actual casting of the ductile iron, breaking out of the mould, and exposing to the first austenitizing temperature. This allows the temperature of the cast iron to remain substantially high enough to prevent the start of the Eutectoid transformation as much as possible, in an embodiment without starting any Eutectoid transformation. Thus, austenitizing may be started immediately afterwards, preventing coarsening, and saving energy and time. Suitable forming methods include vacuum moulding, a lost foam process, investment casting (lost wax technique), and permanent moulds (metal).

In order to achieve a fast rate of heating or cooling to the second austenitizing temperature, use may be made of a fluidized bed. A fluidized bed yields a relatively large heat transfer, such that the cast iron experiences relatively fast heating and/or cooling, e.g. in the austenite temperature region. For instance, a fluidized bed with a temperature gradient may be used, in which the cast iron is transported in the direction of the temperature gradient, to change the temperature in the cast iron from the first austenitizing temperature to the second austenitizing temperature. Alternatively, or additionally, the cast iron may be transported from a first fluidized bed (at the first temperature) to a second fluidized bed (at the second temperature). Thus, the temperature may almost instantly be changed from the first temperature to the second temperature. Furthermore, the fluidized bed allows accurate control of the temperature-time-curve. It is noted that the use of a fluidized bed is not restricted to an austenitizing heat treatment.

Furthermore, the fluidized bed allows further treatments to take place, such as surface strengthening using a gas, e.g. such as nitriding or carbonizing.

The carbon concentration distribution in the matrix, resulting from the second austenitizing temperature, may be set by cooling the casting to a third temperature which is below the Eutectoid temperature of the specific class of cast iron (step C). Step C may be performed subsequently to step B. This means that the relatively small layers in the matrix surrounding the graphite particles with a slightly higher or lower carbon concentration relative to the rest of the matrix, respectively, will be set to obtain the desired higher or lower carbon concentration in comparison to the rest of the matrix, with accompanying stress distribution and strength properties.

Although it is possible to cool to room temperature, the third temperature is in an embodiment above the Martensite start temperature for the cast iron, in order to prevent formation of Martensite. This temperature is approximately 200° C. or lower, depending on the Carbon content in the austenite. The cast iron is in an embodiment held for a period of time at this third temperature.

When cooling towards the third temperature, a cooling rate may be used that is high enough to prevent the formation of ferrite, pearlite or ausferrite before the third temperature is reached. A fluidized bed may be suitable for this purpose, since highly controllable temperature-time-curves are possible (even though cooling rates for salt baths are higher). For cooling, conventional techniques may also be used. For instance, it is possible to quench the casting in a salt bath in which higher cooling rates may be realised. A fluidized bed, however, is advantageous compared to a salt bath, with better controllable cooling conditions, no corrosion of cast iron surfaces and less undesired environmental effects when using a fluidized bed. Other techniques, which are considered to be known to the person skilled in the art, may also be used.

In an embodiment of the invention, the cast iron is subjected to an austempering heat treatment. The austempering heat treatment takes place after the step of subjecting the casting to the second austenitizing temperature. In an embodiment, the austempering heat treatment takes place after cooling towards the third temperature.

The method according to the invention advantageously allows the possibility of a (multi-) stepped cooling and austempering treatment specially designed for the realized carbon gradient: e.g. especially designed for the high % C-levels regions in the matrix microstructure or e.g. especially designed for the lower % C-level regions in the microstructure. Herewith the optimal combination of properties can be realized to answer the functional requirements such as fatigue strength, fracture toughness, ductility, machinability, wear-resistance, etcetera.

The austempering heat treatment includes the subjecting of the cast iron to an austempering temperature, in an embodiment subsequently to step C. The casting is held at the austempering temperature (or temperatures) for a certain time (following a well-defined temperature-time-curve during the austempering stage) realizing the intended matrix microstructure of a fine or coarse ausferrite with sufficient saturated residual austenite that prevents martensite from forming during (deep)cooling, or an austenite phase which transforms partially to martensite during (deep)cooling, providing the improved, tailored high-strength properties aimed at such as: maximum strength, fatigue strength, or toughness (at room temperature or at e.g. −40° C.)—depending on the desired application. The carbon gradient obtained in the austenite matrix between two graphite particles is a result of the chosen temperature and time for the first austenitizing step A, and of the chosen temperature and time for the second austenitizing step B. The carbon gradient, more precisely the carbon concentration in a layer surrounding the graphite particles relative to the carbon distribution in the rest of the matrix, in combination with the chosen austempering procedure, is decisive for the desired/taylored (fracture) mechanical properties realized by the chosen austempering procedure of the final product. The intended result may be a combination of strength and toughness and wear resistance and machinability, for example.

At a sufficient high cooling rate the austempering starts at the third temperature, and this temperature is maintained until the residual austenite has become sufficiently stable at ambient temperature. The cooling rate may be in the order of 50 degrees Celsius per second. The time for the austenite to become stable may be in the order of 15 minutes to 1 hour. After the austempering, the casting is cooled to room temperature.

Austempered/ausferritic cast irons (including Austempered ductile iron, ADI) possesses excellent comprehensive properties, more specifically higher strength and toughness properties compared to regular (heat treated) cast irons. When the density of graphite particles increases, especially in ductile iron and thin walled iron castings, the properties (or combination of properties) are further improved. In general a higher density of graphite particles in the casting comes together with less solidification and segregation effects. A finer matrix grain structure is obtained, resulting in improved high strength properties.

At present, Austempered Ductile Iron (ADI) castings are, compared to conventional ductile iron, interesting and/or important because of their high strength properties (tailored combination of high strength properties) concerning e.g. tensile strength, fatigue strength, and/or fracture toughness. Compared to steel castings or forgings of the same strength, the cost of casting and heat treatment for ADI is much lower. High-strength ADI cast alloys are therefore increasingly being used as an alternative to welded structures or steel castings or steel forgings or heat treated Aluminium castings when fatigue strength and weight are critical, providing cost-savings and weight savings since those components are heavier and more expensive to manufacture and finish than components made from ADI.

In combination with the austenitizing heat treatment according to the invention to induce controlled change in at least part of the cast iron, an austempering heat treatment as described above results in a further increase in tailored strength properties, compared to conventional methods.

In an embodiment, the cast iron is subjected to a second, different austempering temperature, subsequently to the step of subjecting the cast iron to the austempering temperature. The (at least) two step austempering process has several advantages: reduction of process time, influencing optionally a fine or coarse ausferrite, a high or low % residual austenite, a high or low (saturated or (partially) unsaturated) solution of carbon in the residual austenite with the possibility of complete or incomplete transformation from this austenite to martensite during cooling to ambient temperature or during deepcooling to e.g. −196° C. (liquid nitrogen at 1 bar).

In an embodiment, the second austempering temperature is higher than the first austempering temperature. Starting with a lower austempering temperature assures a higher cooling rate, but principally provides at this lower temperature (above the martensite start temperature) a quick dense nucleation situation for the ferrite and after this short period (one to some minutes) the temperature is increased to a higher region for transformation to ausferrite to accelerate the transformation and increase the amount of carbon solution in the residual austenite at a higher transformation temperature.

In an embodiment of the invention, the austempering temperature is equal to, or higher than, the third temperature. In other words, the third temperature may be lower than the initial austempering temperature. This may be beneficial, especially for relatively thick iron castings. In this case the casting is cooled to a temperature below the initial austempering temperature. It should be noted that in case austempering is desired, the third temperature is always higher than the martensite starting temperature. Especially the outer regions of the casting may be cooled to below the initial austempering temperature. The core, however, may respond more slowly to the change in temperature, especially in thick castings. To allow the complete casting (including the core) or at least selected and desired parts of the casting to start the austempering heat treatment at the desired austempering temperature, the austempering temperature is equal to, or higher than, the third temperature.

According to an aspect of the invention, a method of heat treating a cast iron having graphite particles, in particular ductile cast iron having graphite particles with a substantially spherical geometry is provided. The method comprises the steps of I. subjecting the cast iron to a first austenitizing temperature, in order to obtain a cast iron having an austenite matrix with a substantially homogeneous carbon content; and II. prior to step I., casting and solidifying a cast iron from a melt for forming the cast iron having graphite particles.

The method is characterised in that the method further comprises the step of, in between step II. and step I., preventing an Eutectoid transformation to take place in the cast iron, in an embodiment by holding the temperature of the cast iron substantially above the Eutectoid temperature.

It will be apparent that advantages of this method have already been explained above. In brief, the method saves a lot of energy, and the formation of unwanted (pro-eutectic) ferrite structures in the cast iron is prevented. The prevention of formation of ferrite structure also has a positive influence on further heat treatment steps, such as austenitizing and austempering. Preventing an Eutectoid transformation may be done by exposing the cast iron to a temperature above the Eutectoid temperature. Alternatively, the temperature of the cast iron may drop (slightly) below the Eutectoid temperature for a short period of time, such that the Eutectoid transformation does not yet start. In an embodiment, however, the temperature of the cast iron is held substantially above the Eutectoid temperature.

It is possible, that subsequently to step I, at least part of the cast iron is subjected to a second austenitizing temperature, the first austenitizing temperature and the second austenitizing temperature being different relative to each other, for changing, in at least part of the cast iron, the carbon concentration in a part of the matrix surrounding the spherical geometry of the graphite particles.

In an embodiment, the second austenitizing temperature is higher than the first austenitizing temperature.

Figure 2:
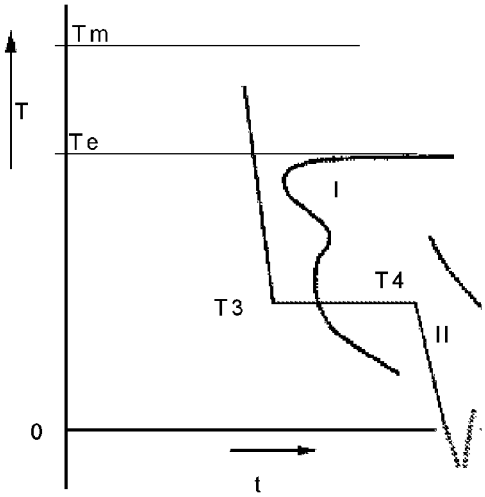
Figure 3A:
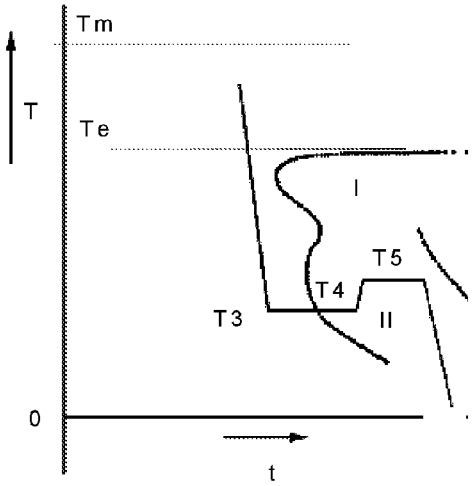
Figure 3B:
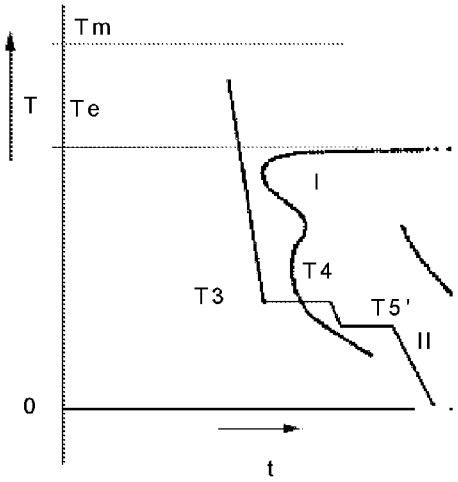
Figure 3C:
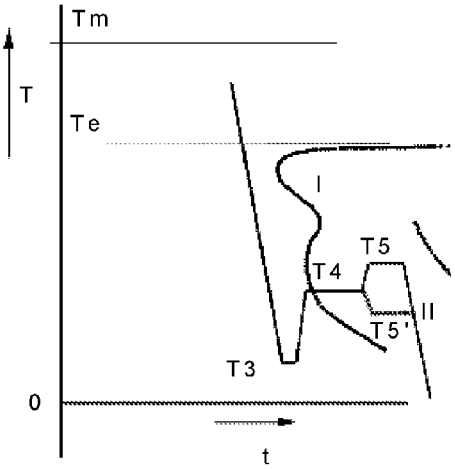

In the following description, embodiments of the heat treating method according to the invention will be explained, based on the accompanying figures, in which:

FIG. 1*a* to FIG. 1*d* show schematic time-temperature diagrams of embodiments of an austenitizing heat treating method;

FIG. 2 shows a schematic time-temperature diagram of an austempering heat treating method;

FIG. 3*a* to FIG. 3*c* show schematic time-temperature diagrams of alternative embodiments of austempering heat treating methods.

Figure 4:
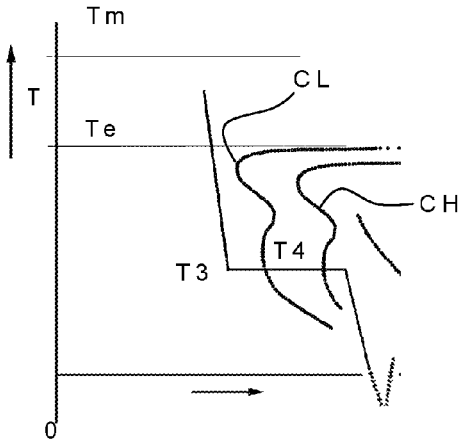
Figure 5A:
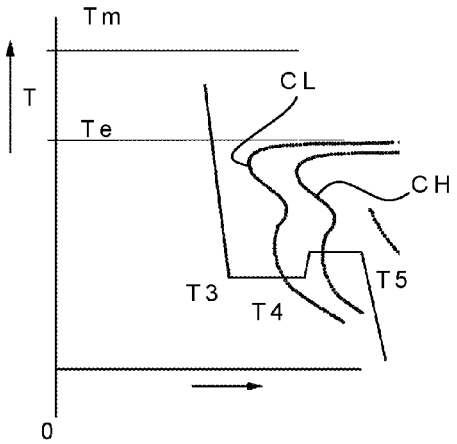
Figure 5B:
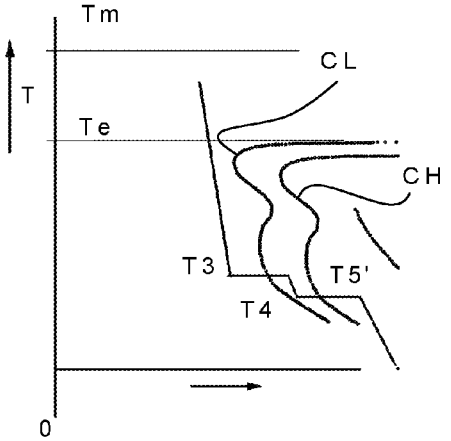
Figure 5C:
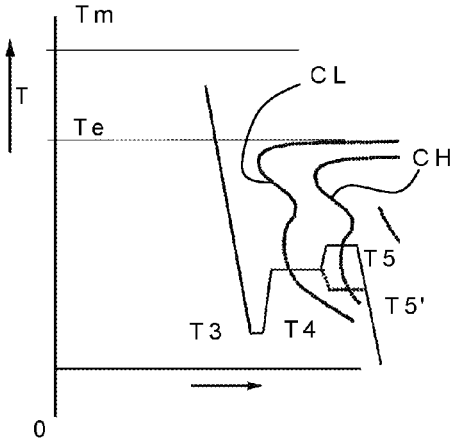

FIG. 4 shows a schematic time-temperature diagram of an austempering heat treating method in which different carbon content resulting from the austenitizing heat treatment is accounted for; and FIG. 5*a* to FIG. 5*c* show schematic time-temperature diagrams of alternative embodiments of austempering heat treating methods, in which different carbon content resulting from the austenitizing heat treatment is accounted for.

FIG. 1*a* to FIG. 1*d* show time-temperature diagrams. On the horizontal axis is time, and on the vertical axis is temperature. The Eutectic solidification temperature is indicated by reference Tm. The Eutectic temperature may be approximately 1150° C. The Eutectoid temperature is indicated by reference Te. The Eutectoid temperature may be in the range of 750° C. to 950° C., and depends (amongst others) strongly on a cooling or a heating situation (kinetic effects) and on the Silicon content of the cast iron. In between the Eutectoid temperature Te and the Eutectic temperature Tm lies the so-called austenite region, in which formation of austenite, with in an embodiment a homogeneous interstitial distribution of Carbon, occurs. The line in the diagram schematically shows the (average or indicative) temperature of the cast iron as a function of time, during the heat treating method.

In FIG. 1*a*, the cast iron starts at room temperature. The cast iron is heated to a first austenitizing temperature T1. This temperature T1 is above the Eutectoid temperature Te, and below the melting temperature Tm. The cast iron having graphite particles, is held at this first austenitizing temperature (T1) until the entire casting becomes essentially austenitic and the matrix becomes saturated with a carbon level belonging to the chosen austenitizing temperature. After a while, in a subsequent second step, the cast iron is heated (solid line) or cooled (dashed line) within the austenitizing temperature region, to a second temperature T2 or T2', respectively. The second temperature T2, T2' is different from the first temperature. As can be seen in FIG. 1*a*, the heating or cooling to the second temperature T2, T2' is performed very rapidly. The cast iron is held at this temperature for a relatively short period of time, to influence only a small range around the graphite particles, resulting in locally (i.e. around the particles) increased or decreased Carbon content. After this, the cast iron is relatively rapidly cooled to a temperature T3. This temperature lies below the Eutectoid temperature.

Not shown in FIG. 1*a* is that preceding the exposure to the first austenitizing temperature T1, the casting may be subjected to a pre-austenitizing temperature, which is in an embodiment as high as possible, and more specifically just below the Eutectic melting temperature Tm, to allow the (pro-eutectic) ferritic parts present in the casting to transform to austenite.

The effect of this time-temperature-curve on the cast iron, and more specifically the change in austenitizing temperature, is that graphite atoms will diffuse from the graphite particles into the matrix when the second temperature is higher (solid line), or from the matrix to the graphite particles when the second temperature is lower (dashed line). Due to this, a relatively small substantially spherical layer in the matrix surrounding the graphite nodule will form, in which the graphite concentration is higher (solid line) or lower (dashed line) relative to the rest of the matrix. As described before, this slightly higher or lower graphite concentration around the graphite particles results in a change in strength properties characteristics of the cast iron. When subjected to a higher second temperature T2, the cast iron will increase in strength properties. Also, a detrimental effect of cooling towards the third temperature T3 is countered, as described before. When subjected to a lower second temperature T2', the cast iron will decrease in strength and hardness but will show improved ductility. Thus, the strength properties of the cast iron may be controlled by using a second, different austenitizing temperature.

Figure 1B:
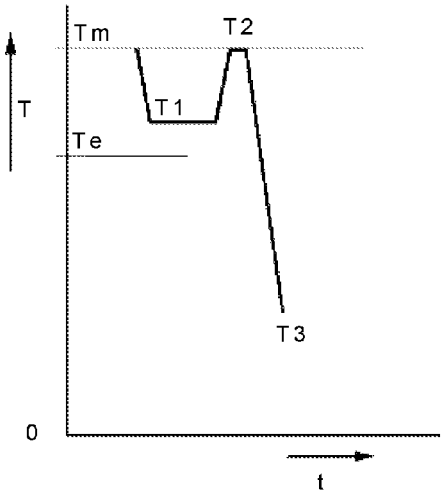
Figure 1C:
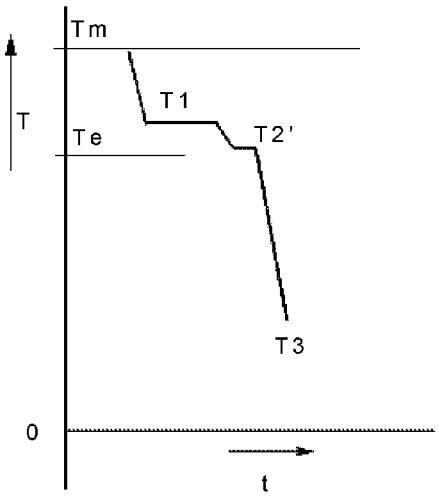
Figure 1D:
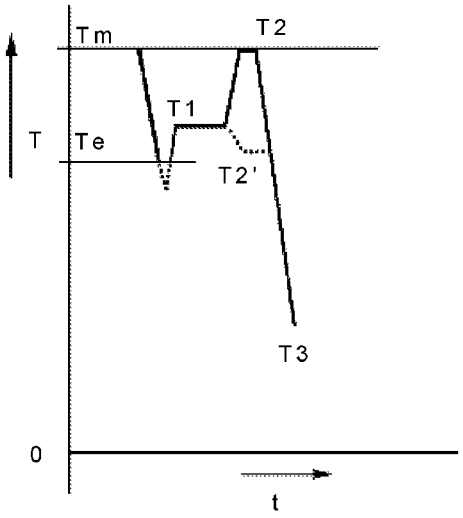

FIG. 1*b* to FIG. 1*d* show embodiments of the heat treating method. In these embodiments, large energy savings may be obtained. Instead of heating the cast iron from room temperature to the first austenitizing temperature T1, the cast iron is subjected to the first austenitizing temperature T1 directly after the step of casting and solidifying the cast iron from a melt for forming cast iron having graphite particles, e.g. with a substantially spherical geometry. By doing so, a large amount of energy may be saved, since no heat is required to heat the cast iron to the first austenitizing temperature. A further important advantage is that the formation of (pro-eutectic) ferrite is prevented. Once formed, this pro-eutectic ferrite may in some cases be very stable. Only after a long exposure in the austenitizing temperature range, the pro-eutectic ferrite may transform to austenite, thus increasing the time necessary for the cast iron to become fully austenitic. By directly exposing the cast iron to the first austenitizing temperature after solidification, austenitizing times may be shorter, resulting in less coarsening of the austenite microstructure, and also further improvements in subsequent heat treatment steps are obtained.

Although FIG. 1*c* and FIG. 1*d* both show a heat treating method in which a second austenitizing temperature T2, T2' is used, it should be noted that energy savings may be obtained for any austenitizing method that is directly started after the casting and solidification of the metal (i.e. that is started while maintaining the temperature of the cast substantially above the Eutectoid temperature Te). A single austenitizing temperature may also be used. The applicant reserves the right to apply for protection for this subject matter, in this application and/or in other applications.

In FIGS. 2 and 3, the ferrite and perlite transformation region (I), and the ausferrite transformation region (II) are schematically indicated by roman numerals I and II, respectively. By selecting the appropriate temperature-time curve, a desired micro-structure in the cast iron may be obtained. In general, this is known to those skilled in the art.

FIG. 2 shows an embodiment of a subsequent austempering method, to further increase the strength properties of the material. Such an austempering method is known per se. In the austempering method, the cast iron is held at a constant temperature to allow the formation of an ausferritic structure.

FIGS. 3*a* to 3*c* show further improvements relating to austempering methods. It should be noted that these improvements have positive effects when combined with the austenitizing heat treatment according to the present invention. Nevertheless, these austempering methods may also be beneficial when the austenitizing heat treatment according to the present invention does not precede the austempering method. The applicant therefore reserves the right to apply for protection for these austempering methods in this application, and/or in other applications.

It can be seen in FIGS. 3*a* and 3*b* that following cooling to the third temperature T3, the austempering is started at the a first austempering temperature T4. In this embodiment, the austempering temperature T4 is equal to the third temperature T3. In the matrix, ausferrite is formed. This temperature is held for a certain period of time. Then, subsequently, the temperature is raised (FIG. 3*a*) or lowered (FIG. 3*b*) to a second, different austempering temperature T5, T5'. The higher temperature T5 causes coarser high-ausferrite, with a higher carbon content in the ausferrite. The lower temperature T5' causes a transformation with finer low-ausferrite, but also a lower carbon content in the ausferrite. The chosen temperature T5 and T5' influences the percentage retained austenite, the coarseness of the ausferrite, and the percentage of carbon in the retained austenite. Thus, the temperature may be used to influence and control the desired characteristics of the cast iron. Finally, the casting is cooled towards room temperature.

A special variant (not shown) is where after starting the austempering at T3, the temperature is lowered after some time, e.g. somewhere halfway the austempering time. After this time, the increasing carbon content results in the Martensite starting temperature to be lower, enabling a lower austempering temperature whilst staying above the Martensite starting temperature.

FIG. 3*c* shows an austempering method that is especially suitable for relatively thick castings. Here, the casting is cooled to the third temperature T3. However, compared to FIG. 3*a*, this third temperature T3 is lower, to allow the core (or at least deeper parts) of the casting to reach a level equal to, or lower than, the desired austempering temperature T4. After this cooling to the relatively low third temperature T3, the casting is subjected to the desired austempering method. Once again, this temperature is held for a certain period of time. Then, subsequently, the temperature may be raised or lowered to a second, different austempering temperature T5, T5'. Finally, the casting is cooled towards room temperature.

In FIGS. 2 and 3, the ferrite and perlite transformation region (I), and the ausferrite transformation region (II) are schematically indicated by roman numerals I and II, respectively. By selecting the appropriate temperature-time curve, a desired micro-structure in the cast iron may be obtained. In general, this is known to those skilled in the art.

It should be noted that with the heat treatment method provided by the invention, it is possible that large gradients in carbon concentrations exist. In different parts of the cast iron, one may find different carbon concentrations. In general, the time and temperature at which a ferrite and pearlite transformation, and/or the ausferrite transformation takes place, depends on the (local) carbon concentration of the cast iron. In general, a higher carbon content results in the transformation taking place later. This effect may be used to influence the material properties, as will be discussed based on FIG. 4 and FIG. 5*a* to FIG. 5*c*.

FIG. 4 shows an embodiment of an austempering method, to further increase the strength properties of the material. It can be seen that a first transformation line CL is shown, which relates to the start of the transformation for the low carbon concentration. Another transformation line CH is visible, which relates to the start of the transformation for the high carbon concentration. The CL transformation line is further referred to as the low carbon transformation line CL. The CH transformation line is further referred to as the high carbon transformation line CH. It can be seen that the CH transformation line relates to a later time period, and generally also to a bit lower temperature. With the austempering method shown in FIG. 4, initially a volume having a low carbon concentration will be subjected to a transformation according to the CL transformation line. A bit later in time, also the volume having a relatively higher carbon concentration will be subjected to a likewise transformation, according to the CH transformation line.

FIGS. 5*a* to 5*c* show further improvements relating to austempering methods using a cast iron having regions with different carbon contents, i.e. a low carbon concentration region and a high carbon concentration region. It should be noted that these improvements are feasible when combined with the multi-stage austenitizing heat treatment according to the present invention.

It can be seen in FIGS. 5*a* and 5*b* that following cooling to the third temperature T3, the austempering for the low carbon concentration is started at the a first austempering temperature T4. In this embodiment, the austempering temperature T4 is equal to the third temperature T3. In the matrix, ausferrite formation is started in the regions with lower carbon content. This temperature is held for a certain period of time. Then, subsequently, the temperature is raised (FIG. 5*a*) or lowered (FIG. 5*b*) to a second, different austempering temperature T5, T5'. The change in temperature is effected just before the CH transformation line is reached. Transformation in the regions having a relatively high carbon concentration has therefore not started yet. The transformation for the higher carbon regions thus starts later, and at a higher or lower temperature, respectively.

The higher transformation temperature T5 (FIG. 5*a*) causes a faster transformation resulting in a coarser ausferrite containing less acicular ferrite and more retained austenite. The lower transformation temperature T5' (FIG. 5*b*) causes a slower transformation resulting in a finer ausferrite phase containing more acicular ferrite and less retained austenite. The higher transformation temperature T5 (FIG. 5*a*) causes a faster transformation resulting in less and coarser high-ausferrite phase and lower carbon content in the retained austenite. The lower transformation temperature T5' (FIG. 5*b*) causes a slower transformation resulting in more and finer low-ausferrite phase and higher carbon content in the retained austenite. The chosen temperature T5 and T5' influences the percentage and coarseness of the retained austenite, the amount and coarseness of the acicular ferrite, the amount and coarseness of the retained austenite and the percentage of carbon in the retained austenite. Thus, the temperature may be used to influence and control the desired characteristics of the cast iron. Finally, the casting is cooled towards room temperature.

A special variant (not shown) is where after starting the austempering at T3, the temperature is lowered after some time, e.g. somewhere halfway the austempering time, in an embodiment before the CH transformation line is reached. After this time, the increasing carbon content in the retained austenite results in the Martensite starting temperature to be lower, enabling lower austempering temperatures whilst staying above the Martensite starting temperature.

Another special variant (not shown) is starting a partial Martensite transformation at a temperature T3 just below the Martensite starting temperature directly followed by the austempering transformation at T4 and subsequently T5 or T5'.

FIG. 5*c* shows an austempering method that is especially suitable for relatively thick castings. Here, the casting is cooled to the third temperature T3. However, compared to FIG. 5*a*, this third temperature T3 is lower, to allow the core (or at least deeper parts) of the casting to reach a level equal to, or lower than, the desired austempering temperature T4. After this cooling to the relatively low third temperature T3, the casting is subjected to the desired austempering method. Once again, this temperature is held for a certain period of time. Then, subsequently, the temperature may be raised or lowered to a second, different austempering temperature T5, T5', just before the HC transformation line is reached. Finally, the casting is cooled towards room temperature.

The method according to the invention is especially suitable for large scale production of iron castings with graphite particles, in particular ductile iron castings, having improved strength characteristics. With the method according to the invention, and improvements thereon, large energy savings and (resulting) environmental benefits are obtainable.

It may be clear to a person skilled in the art, that the invention has been described based on several embodiments thereof. Alternatives and modifications may be made, all of which may be within the scope of the requested protection according to the attached claims.

The invention claimed is:

1. Method of heat treating a cast iron having graphite particles with a spherical geometry, the method comprising:

A. subjecting the cast iron to a first austenitizing temperature (T1), in order to obtain a cast iron having an austenite matrix with a homogeneous carbon content;

characterised in that:

B. directly after step A, at least part of the cast iron is subjected to a second austenitizing temperature (T2), the first austenitizing temperature and the second austenitizing temperature being different relative to each other, wherein the second austenitizing temperature (T2) is higher than the first austenitizing temperature (T1), wherein in at least part of the cast iron, the carbon concentration in a part of the matrix surrounding the graphite particles, are changed.

2. Method according to claim 1, further comprising step D of, prior to step A, casting and solidifying a cast iron from a melt, for forming cast iron having graphite particles, wherein the method further comprises, in between step D and step A, preventing an Eutectoid transformation to take place in the cast iron by holding the temperature of the cast iron substantially above a Eutectoid temperature.

3. Method according to claim 2, wherein during the step of casting of the cast iron from the melt, a moulding method that allows a quick transition from the casting of the cast iron, breaking out of the mould, and exposing to the first austenitizing temperature is performed.

4. Method according to claim 1, wherein the cast iron is held at the second austenitizing temperature (T2) for a period of time.

5. Method according to claim 1, wherein a fluidized bed is used to perform said method.

6. Method according to claim 1, comprising step C of, subsequently to step B, cooling and holding the cast iron at a third temperature (T3) for a period of time, wherein said third temperature is below a Eutectoid temperature of the cast iron, wherein the third temperature (T3) is above a Martensite temperature for the cast iron.

7. Method according to claim 6, wherein the cast iron is cooled towards the third temperature (T3) with a rate of cooling that prevents formation of ferrite, perlite or ausferrite during cooling before reaching the third temperature (T3).

8. Method according to claim 6, wherein subsequently to step C, the cast iron is subjected to an austempering heat treatment, wherein the austempering heat treatment includes subjecting the cast iron to a first austempering temperature (T4).

9. Method according to claim 8, wherein subsequently to the step of subjecting the cast iron to the first austempering temperature (T4), the cast iron is subjected to a second austempering temperature (T5), the first austempering temperature and the second austempering temperature being different relative to each other, wherein the second austempering temperature (T5) is higher than the first austempering temperature (T4).

10. Method according to claim 8, wherein the austempering temperature (T4) is equal to, or higher than, the third temperature (T3) in step C.

* * * * *